US006005519A

United States Patent [19]

Burns

[11] Patent Number: 6,005,519

[45] Date of Patent: Dec. 21, 1999

[54] TUNABLE MICROSTRIP ANTENNA AND METHOD FOR TUNING THE SAME

[75] Inventor: Lawrence M. Burns, Mountain View, Calif.

[73] Assignee: 3 Com Corporation, Santa Clara, Calif.

[21] Appl. No.: 08/707,558

[22] Filed: Sep. 4, 1996

[51] Int. Cl.[6] ..... H01Q 1/38

[52] U.S. Cl. ..... 343/700 MS

[58] Field of Search ..... 343/700 MS; H01Q 21/06

[56] References Cited

U.S. PATENT DOCUMENTS

| | | | |
|---|---|---|---|
| 4,475,108 | 10/1984 | Moser . | |
| 4,697,189 | 9/1987 | Ness . | |
| 4,749,996 | 6/1988 | Tresselt . | |
| 4,755,820 | 7/1988 | Backhouse et al. . | |
| 4,847,625 | 7/1989 | Dietrich et al. . | |
| 4,924,236 | 5/1990 | Schuss et al. . | |
| 4,973,972 | 11/1990 | Huang . | |
| 5,001,493 | 3/1991 | Patin et al. | 343/700 MS |
| 5,220,334 | 6/1993 | Raguenet et al. . | |
| 5,245,745 | 9/1993 | Jensen et al. | 343/700 MS |
| 5,337,060 | 8/1994 | Harada | 343/700 MS |
| 5,408,241 | 4/1995 | Shattuck, Jr. et al. . | |
| 5,777,581 | 7/1998 | Lilly et al. | 343/700 MS |

FOREIGN PATENT DOCUMENTS

| | | | |
|---|---|---|---|
| 0133317 A2 | 2/1985 | European Pat. Off. . | |
| 154-858 | 9/1985 | Germany | H01Q 21/06 |
| 5-90827 | of 1993 | Japan . | |

*Primary Examiner*—Don Wong
*Assistant Examiner*—Hoang Nguyen
*Attorney, Agent, or Firm*—Wilson Sonsini Goodrich & Rosati

[57] ABSTRACT

A broad band tunable microstrip antenna is realized. A substrate layer with a high dielectric constant is placed between a radiating element and a ground plane layer. The electrically conductive radiating element is fabricated on the substrate layer such that a main patch surrounded by a number of individual tuning patches connected to the main patch and to each other are provided. During the tuning process, the effective length and effective width can be selectively adjusted by disconnecting individual tuning patches. In addition to broadening the bandwidth of the microstrip antenna, the optimal feed point can be selected. In other embodiments, the individual tuning patches are initially disconnected from each other and the main patch. During the tuning process, the individual tuning patches are selectively connected or soldered to the main patch. Furthermore, tuning can also be accomplished by connecting or disconnecting individual tuning patches to obtain the desired dimensions of the radiating element. An array of tunable microstrip antennas is also realized. With appropriate coupling to a transmitter/receiver via a feed point, the tunable microstrip antenna, or an array of tunable microstrip antennas, can be used for transmitting and receiving electromagnetic signals, particularly in wireless computer network applications.

27 Claims, 7 Drawing Sheets

TUNABLE MICROSTRIP ANTENNA AND METHOD FOR TUNING THE SAME

BACKGROUND OF THE INVENTION

1. Field of the Invention

The present invention relates to microstrip antennas; and more particularly, to tunable microstrip antennas having bandwidths adjustable by double-stub tuning.

2. Description of Related Art

A microstrip antenna is used for the transmission and reception of electromagnetic energy. As opposed to a conventional wire-based antenna, the microstrip antenna comprises a plurality of generally planar layers including a radiating element, an intermediate dielectric layer, and a ground plane layer. The radiating element is an electrically conductive material imbedded or photoetched on the intermediate layer and is generally exposed to free space. Depending on the characteristics of the transmitted electromagnetic energy desired, the radiating element may be square, rectangular, triangular, or circular and is separated from the ground plane layer. The separation is provided by the intermediate layer, a substrate with a particular dielectric constant, to space the ground plane from the radiating element such that the radiating resonant energy and the corresponding radiation pattern are formed.

A power-driven transmitter and/or receiver network (i.e., transceiver) is generally coupled to the microstrip antenna via a feed point and feed line. Generally, the location of the feed point is selected for optimum matching conditions. When coupled to the transceiver, these three layers contribute to the functions of feed coupling, impedance matching, radiation, and bandwidth shaping.

Microstrip antennas are generally practical for application at frequencies between approximately 1 GHz and 20 GHz. Although no theoretical limit exists, high losses are encountered at frequencies above 20 GHz. Below 1 GHz, wire antennas are more practical because of the large size of the antenna needed.

Microstrip antennas provide advantages such as small size, low weight, low cost, high performance, ease of installation, and aerodynamic profile. Using modern printed circuit techniques, microstrip antennas are mechanically robust when mounted to a rigid surface. They are also versatile elements; they can be designed to produce a wide variety of patterns and polarizations, depending on the mode excited and the particular shape of the radiating element used.

Despite these advantages, a major limitation of a microstrip antenna is its narrow frequency bandwidth. The operating frequency for a microstrip antenna may only be varied from a fraction of a percent to a few percent (approximately 2% to 3%) of its center resonance frequency without severe degradation in performance. The relatively high Q, and hence the narrow bandwidth of the microstrip antenna, is a result of the high dielectric constant of the intermediate substrate layer. However, the high dielectric constant of the intermediate substrate layer allows the desirable physically small size of the microstrip antenna. In essence, the narrow bandwidth results from the radiation impedance infringing capacitance at the edges of the radiating element being much higher than 50 ohms.

One method by which a bandwidth can be increased is by using a matching circuit to drive the antenna. However, the matching circuit takes up additional space on the board, thus effectively adding to the physical size of the antennas and defeating the purpose of the low profile nature of these antennas. The matching network also adds to the loss of the antenna circuit.

In addition to the narrow bandwidth, microstrip antennas have no provision for tuning during and after the manufacturing process. After the feed point is selected, the feed point location, bandwidth, and resonance frequency of the microstrip antenna are fixed.

As discussed above, the use of microstrip or printed circuit techniques to construct antennas has recently emerged as a consequence of the need for increased miniaturization, decreased cost, and improved reliability. However, these microstrip antennas have relatively narrow operational bandwidth which limits tunability of the devices. In general, the antennas should have as wide a bandwidth as possible for various wide band applications.

SUMMARY OF THE INVENTION

The present invention provides a tunable microstrip antenna having a bandwidth that is wider than conventional microstrip antennas, and which is adjustable by double-stub tuning.

In particular, the tunable microstrip antenna comprises a radiating element, a dielectric substrate layer, and a reference layer coupled to ground or another reference potential. The radiating element, coupled to the substrate layer, has a first dimension and a second dimension where at least one of the first dimension and the second dimension is adjustable during the tuning process.

As an example, the first dimension is effective length and the second dimension is effective width. The effective length establishes a first resonant frequency corresponding to a first bandwidth. The effective width establishes a second resonant frequency corresponding to a second bandwidth. When tuned to form the wide bandwidth, the effective length and the effective width are slightly different such that the first bandwidth and the second bandwidth overlap to form an element bandwidth that is greater than either the first bandwidth or the second bandwidth.

The radiating element includes a radiating member and a plurality of tuning members. The tuning members and the radiating member are formed by conductive patches on the dielectric substrate. To adjust the first dimension, the second dimension, or both, selected tuning members are connected to or disconnected from the radiating member to form the radiating element.

In some embodiments, the plurality of tuning members and the radiating member are normally connected to each other prior to tuning. In other embodiments, the plurality of tuning members and the radiating member are normally disconnected from each other prior to tuning. The combination of tuning members and radiating member connected to each other forms the radiating element. In one embodiment, the tuning members surround at least a portion of the perimeter of the radiating member. For more flexible implementations, the tuning members surround the entire perimeter.

When viewed from a direction orthogonal to the radiating element, the radiating element is shaped substantially as a rectangle, a rectangle with chamfered corners, an oval, a circle, or any other shape desired.

The tunable microstrip antenna comprises a feed point coupled to the radiating member at a particular location in the radiating member for transmitting or receiving an electromagnetic signal. The feed point establishes a radiation impedance for the antenna which varies with the location of the feed point.

Additionally, the invention utilizes a transceiver for processing the electromagnetic signal and a feed line coupling the transceiver to the feed point. The feed line has a feed line impedance. For appropriate matching in most commercial systems, the feed point is located on the radiating element where the radiation impedance is equal to or less than 50 ohms. Ideally, the feed point is located on the radiating element where the radiation impedance is substantially equal to the feed line impedance.

The feed point location on the radiating element is tunable according to the present invention, by selectively adjusting the first dimension, the second dimension, or both to locate the feed point on the radiating element where the radiation impedance is equal to about 50 ohms or another desired matching impedance. In other embodiments, the adjustment is made to locate the feed point on the radiating element where the radiation impedance matches a feed line impedance Once an individual antenna has been tuned for bandwidth and impedance for a given manufacturing process, the antennas can be mass produced with the tuned characteristics, by incorporating the pattern of connections and disconnections into the manufacturing process. This allows for large scale manufacturing of tuned ceramic patch antennas.

DETAILED DESCRIPTION OF PREFERRED EMBODIMENTS

Figure 1:
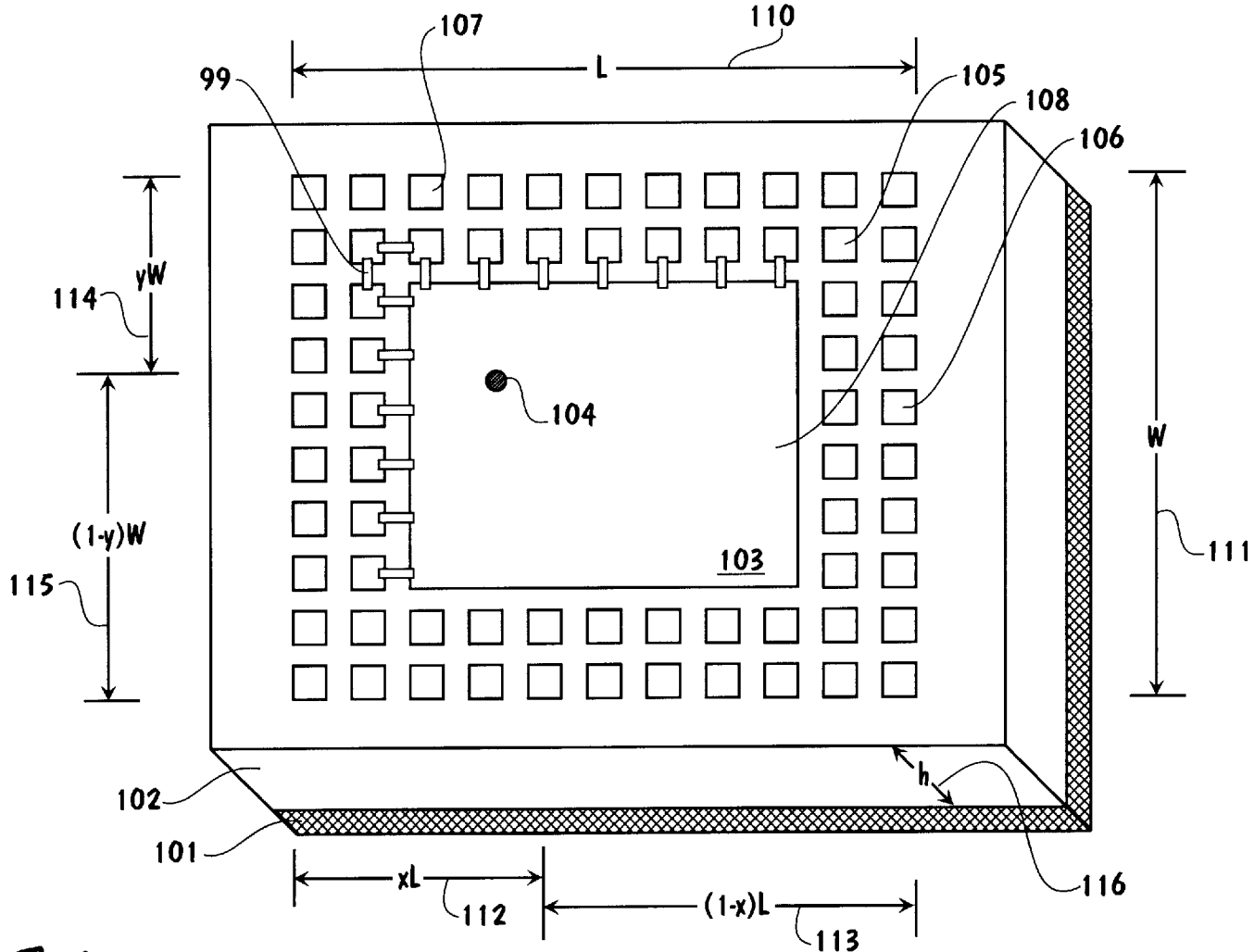
FIG. 1 illustrates a ceramic patch antenna according to the present invention.

FIG. 1 shows a perspective view of one embodiment of the present invention. In this embodiment, the tunable microstrip antenna is rectangular in shape as viewed from above. A substrate 102 is placed on ground plane 101. The substrate 102 has a particular dielectric constant $\in R$ and a particular height 116 from the ground plane.

The substrate is preferably formed from a sheet of dielectric material, such as alumina, polystyrene, teflon fiberglass, or the like. One such fiberglass material is commercially available under the trademark DUROID. Preferably, the present invention uses materials with high dielectric constants ($\in R>5$) to take advantage of the low profile feature of this antenna. One preferred alumina substrate material has a dielectric constant $\in R$ equal to about 9.6.

In accordance with one embodiment of the present invention, a radiating element or radiator 108 is imbedded or photoetched on the substrate 102. The radiator 108 comprises a main patch 103 and individual tuning patches surrounding and connected to the main patch 103. Representative individual tuning patches include tuning patch 107 (along a first side orthogonal to the width W), tuning patch 106 (along a second side orthogonal to the length L), and tuning patch 105 (at the corner). These individual tuning patches, in this example, are selectively connected to each other and to the main patch 103 and by conductors, e.g. conductor 99, and selectively disconnected during the tuning process.

The ground plane layer and radiating element may be adhered, sprayed, screened, or vapor deposited on the substrate layer as is well known in the art of sheet covering. The conducting radiator 108 is preferably copper foil but can be other materials with excellent conductive properties, such as silver or gold. Preferably, the microstrip may be manufactured by taking a dielectric substrate layer having conductive layers on both sides and then photoetching the desired pattern on one side such as is accomplished when manufacturing printed circuit boards. For the protection of the conductive surfaces, the tunable microstrip antenna may be overlapped with an insulated lamina of protective material like polystyrene after manufacture.

The tunable microstrip antenna of the present invention is connected to a transmitter and/or receiver (not shown) through feed point 104. The location of feed point 104 is selected such that resonance is achieved; that is, the radiation impedance of the feed point will be approximately equal to the feed line, or transmission line, impedance. Typically, the optimum feed point radiation impedance is less than or equal to 70 ohms. Usually, the optimum radiation impedance is 50 ohms.

The optimum feed point location is not unique; many optimum feed point locations exist. If exact matching is not possible, the impedance at the feed point should be slightly greater or slightly less than the feed line impedance. If the impedance mismatch is severe, such as VSWR greater than 1.5, power loss, voltage breakdown, and thermal degradation of the feed line will occur. High VSWR represents high reflected power, thus less power is delivered to the antenna and a significantly large amount of power is consumed by the transmitter.

From this feed point 104, the length (L) of the radiator 108 can be separated into two components—a component 112 (given by the distance xL, where x is a fraction) and a component 113 (given by the distance (1−x)L). The width (W) component of radiator 108 can also be separated into two components—a component 114 (given by the distance yW, where y is a fraction) and a component 115 (given by the distance (1−y)W). In this example, the overall length of the radiator 108 is L and the overall width of the radiator 108 is W.

In accordance with one embodiment of the present invention, the radiator 108 comprising individual tuning patches, such as tuning patches 105, 106, 107, and main patch 103, can be tuned by selectively connecting and/or disconnecting the interconnections among the individual tuning patches to each other and to the main patch 103. Thus, to vary the length or width of the radiator 108, the individual tuning patches or a set of tuning patches can be removed or disconnected from the other individual tuning patches and the main patch 103.

In other embodiments of the present invention, the individual tuning patches are normally connected to each other and the main patch 103. During the tuning process, these individual tuning patches are selectively disconnected from the main patch and, when desired, from each other. The tuning process will be described in greater detail later accompanying the discussion of another embodiment of the present invention.

Figure 2:
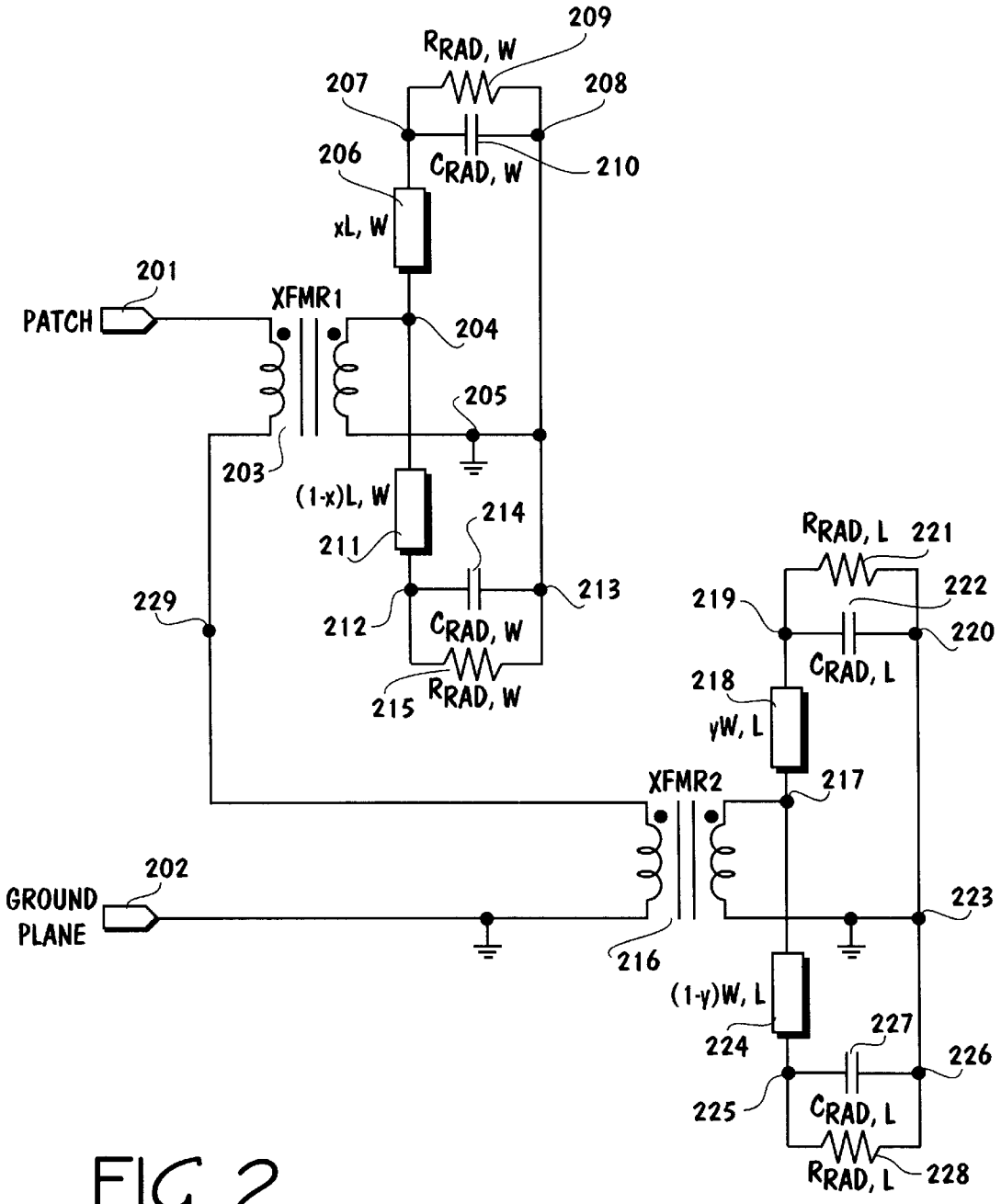
FIG. 2 is an equivalent circuit diagram of the embodiment of FIG. 1.

FIG. 2 shows an equivalent circuit of the microstrip antenna. The equivalent circuit is merely a model representation. No actual circuit exists. As FIG. 2 shows, the microstrip antenna can be modeled as two sets of radiating impedances formed by $R_{RAD,W}$, $C_{RAD,W}$ and $R_{RAD,L}$, $C_{RAD,L}$ at each end of the radiator driven by two transmission lines formed by the inset feed point of the microstrip. By choosing the appropriate feed point location, the relatively high radiation impedance will decrease to 50 ohms for appropriate matching with the power driving circuit (not shown) coupled to the microstrip antenna. As the equivalent circuit shows, the microstrip antenna has both the length L and width W explicitly accounted for. Instead of choosing W arbitrarily, both L and W are chosen so that the tunable microstrip antenna will resonate at two slightly different frequencies. When these two frequencies are close enough (by adjusting L and W accordingly), a wider bandwidth results.

The patch terminal 201 provides the power and signal source to the equivalent circuit. Ground plane terminal 202 provides the ground for the equivalent circuit. Patch terminal 201 is coupled to the dotted terminal of transformer 203 to transfer the power and the signal to the equivalent circuit. The corresponding in-phase dotted terminal of transformer 203 is connected to node 204. Radiating element 206 with dimensions xL and W is connected between node 204 and node 207. Width-dependent resistor 209 with resistance $R_{RAD,W}$ is connected between nodes 207 and 208. Width-dependent capacitor 210 with capacitance $C_{RAD,W}$ is connected between nodes 207 and 208. Radiating element 211 with dimension (1−x)L and W is connected between nodes 204 and 212. Width-dependent capacitor 214 with capacitance $C_{RAD,W}$ is connected between nodes 212 and 213. Width-dependent resistor 215 with resistance $R_{RAD,W}$ is connected between nodes 212 and 213. Nodes 208 and 213 are connected to ground at node 205.

The non-dotted terminal of transformer 203 is connected to the dotted terminal of transformer 216 at node 229. The non-dotted terminal of transformer 216 is connected to ground plane 202. The corresponding dotted in-phase terminal of transformer 216 is connected to node 217. Radiating element 218 with dimensions yW and L is connected between nodes 217 and 219. Length-dependent resistor 221 with resistance $R_{RAD,L}$ is connected between nodes 219 and 220. Length-dependent capacitor 222 with capacitance $C_{RAD,L}$ is connected between nodes 219 and 220. The corresponding non-dotted out-of-phase terminal of transformer 216 is connected to ground at node 223. Radiating element 224 with dimension (1−y)W and L is connected between nodes 217 and 225. Length-dependent resistor 228 with resistance $R_{RAD,L}$ is connected between nodes 225 and 226. Length-dependent capacitor 227 with capacitance $C_{RAD,L}$ is connected between nodes 225 and 226. Nodes 220 and 226 are connected to ground at node 223.

Figure 3:
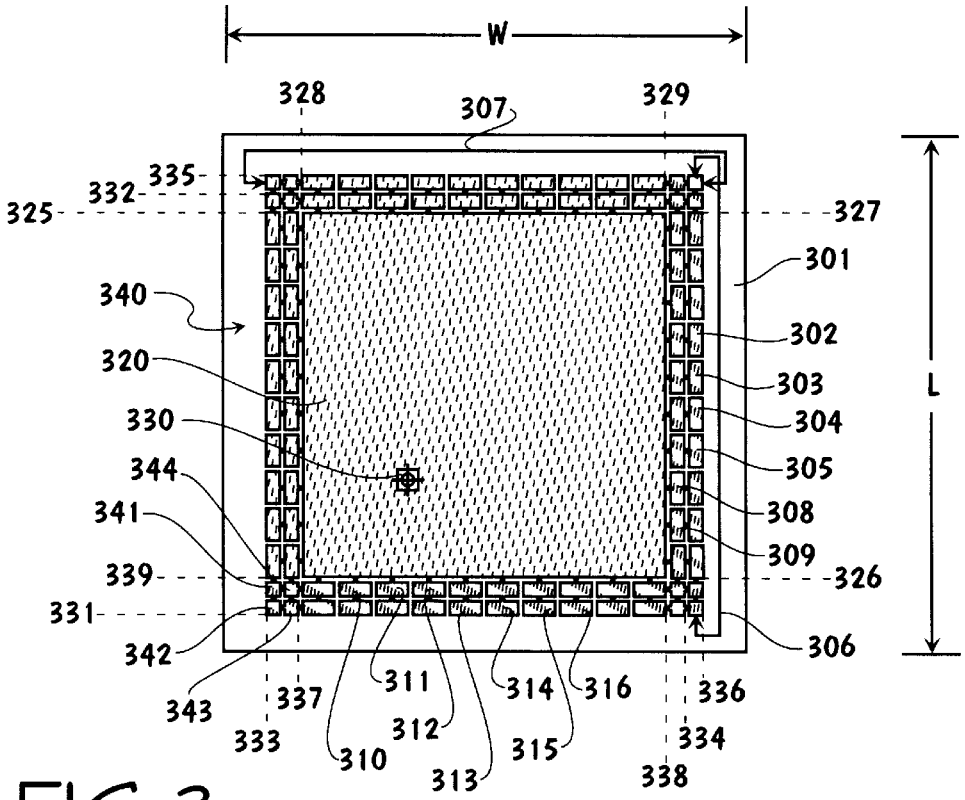
FIG. 3 is a top view of an embodiment of the present invention.

FIG. 3 shows a top view of an embodiment of the present invention. Radiator 340 is placed on top of substrate 301. Initially, the radiator 340 comprises the main patch 320 and the set of individual tuning patches surrounding the edges of the main patch 320. Along the length L of the radiator 340, these individual tuning patches comprise a row of outer tuning patches, including a representative sample of patches 302, 303, 304, 305, and a row of inner tuning patches, including a representative sample of patches 308, 309. Along the width W of the radiator 340, the individual tuning patches comprise a row of outer tuning patches, including a representative sample of patches 313, 314, 315, 316, and a row of inner tuning patches, including a representative sample of patches 310, 311, 312. In one embodiment, these individual tuning patches are connected to each other and the main patch 320.

Prior to the tuning process, feed point 330 is located on the main patch 320. After establishing the location of the feed point on main patch 320, resonance can be obtained by tuning the radiator 340. Tuning may be accomplished by disconnecting the individual tuning patches from the remainder of the radiator 340. For example, to change the length L of radiator 340, an entire row of outer tuning patches 307 may be disconnected from the remaining portions of the radiator 340. Thus, the new length can be calculated from edge 331 to edge 332. Similarly, the width W may be adjusted by disconnecting an entire column of tuning patches 306 from the remaining portions of radiator 340. Thus, the new width can be measured from edge 333 to edge 334. Typically, however, entire rows or columns are not disconnected during the tuning process. Rather, tuning patches are disconnected in incremental fashion. With the individual turning patches and main patch 320 connected together, the initial length L of the microstrip antenna is measured from edge 331 to edge 335. The initial width W of the microstrip antenna is measured from edge 333 to edge 336. The feed point 330 is also initially selected somewhere on the main patch 320.

By adjusting either the length L or the width W and/or by shifting the length L or the width W relative to the feed point (by adding a tuning patch on one side while removing a tuning patch on the opposite side), the effective location of the feed point 330 is also changed, affecting the matching characteristics. Accordingly, by monitoring the effects of the length and width adjustments of the radiator 340 on the bandwidth (via a plot of return loss in dB v. frequency) as well as the feed point matching characteristics, broader bandwidth and optimal matching characteristics may be achieved.

Tuning is accomplished by selectively disconnecting an individual tuning patch or a plurality of individual tuning patches from the combination of the main patch 320 connected to the other individual tuning patches. Disconnection can be accomplished by scribing with a diamond tip scribe. Connection is accomplished by welding with gold ribbon. Solder connections could also be used.

To affect the width W of the microstrip antenna, the group of individual tuning patches bounded by edges 326, 327 and 325, 339 are selectively disconnected. To affect the length L of the microstrip antenna, the group of individual tuning patches bounded by edges 328, 329 and 337, 338 are be selectively disconnected. To simultaneously affect both the length and width of the microstrip antenna, the group of four corner tuning patches are selectively disconnected. One group of corner tuning patches is bounded by edges 325, 328; another group is bounded by edges 327, 329; a third group is bounded by edges 326, 338; and a fourth group is bounded by edges 337, 339. The fourth group includes individual tuning patches 341, 342, 343, 344.

If the radiation impedance at the initial feed point 330 is not 50 ohms, a more optimal feed point location should be found. One optimal feed point is the location where the radiation impedance matches the feed line impedance. Since the feed point 330 is physically fixed during the manufacturing process, the individual tuning patches can be utilized to adjust the length L and the width W in two-dimensional fashion along the plane of radiator 340.

Thus, to move the feed point location effectively closer to edge 331, a tuning patch 313, for example, may be disconnected. By disconnecting a single tuning patch 313, the length of the radiator 340 has been effectively decreased. So, prior to the disconnection of tuning patch 313, the length of the radiator 340 is measured from edge 331 to edge 335. After the disconnection of tuning patch 313, the length of the radiator 340 is some effective length less than the distance between edges 331 and 335. In effect, the edge 331 moved up toward the feed point 330 some distance. If tuning patches 313 and 314 are disconnected, the length of the radiator 340 is decreased even more than if a single tuning patch 313 is disconnected. Accordingly, disconnection of individual tuning patches located between the edges 328, 329 and also edges 337, 338 incrementally (but not necessarily linearly) affects the length L of the radiator 340. The disconnection of these patches has a negligible effect on the width W of the radiator 340. Also, the effective feed hole location can be shifted by disconnecting a patch on one side and adding a patch on the opposite side, while preserving W or L.

Similarly, the selective disconnection of individual tuning patches bounded by edges 325, 339 and also edges 326, 327 affects the width W of the radiator 340. The disconnection of these patches has a negligible effect on the length L of the radiator 340.

Moreover, the selective disconnection of individual tuning patches at the corners of the radiator 340, such as patches 341, 342, 343, 344 bounded by edges 337, 339, simultaneously affects both the length L and width W of the radiator 340. Thus, disconnection of individual tuning patch 342, for example, decreases the effective length L and effective width W of the radiator 340. If individual tuning patch 341 was also disconnected, the effective length L and effective width W would be further decreased.

When an individual tuning patch, such as, for example, 302, is disconnected, the tuning patch 302 radiates at a much higher frequency than the radiator 340 because of the relatively large difference in dimensions; that is, the length and width of tuning patch 302 is much shorter than the length and width of radiator 340. In essence, the disconnected individual timing patch 302 is "invisible" to the microstrip antenna coupled to a resonant circuit.

With the selective disconnection of any one or a group of individual tuning patches, the effective location of the feed point 330 is affected. If a feed point location can be made more optimal by "moving" it closer to one or more edges of the radiator 340, individual tuning patches can be selectively disconnected.

If the length L and width W are equal, their respective resonant frequencies and bandwidths would be equal. If the length L and width W are not equal, the length component and width component of the radiator 340 radiate at their respective distinct resonant frequencies. Preferably the length L and width W differ by less than 5% and preferably about 1% or 2%. When the individual bandwidths of these two components are close enough along the frequency spectrum, the overall bandwidth of the radiator 340 is effectively increased.

Moreover, the bandwidth, and hence the center frequency in the bandwidth, of the microstrip antenna can be moved up or down the frequency spectrum as desired by selectively disconnecting and connecting individual tuning patches to the radiator 340. Thus, if the length L is longer than the width W, the length component of the radiator 340 resonates at a lower frequency than the width component, where the combined bandwidth is increased. By selectively disconnecting an individual tuning patch to decrease the length and selectively connecting an individual tuning patch to increase the width, the center frequency remains the same but the feed point location is changed. Thus, the optimal feed point location may be obtained without affecting the center frequency of the bandwidth. Further tuning can increase or decrease the bandwidth, as desired, without affecting the center frequency.

The embodiment of FIG. 3 is shown with the individual tuning patches connected to each other and the main patch 320. In other embodiments, the individual tuning patches can be initially disconnected to each other and the main patch 320. During the tuning process, these individual tuning patches may be individually or collectively connected to the main patch 320, or in some cases, to each other, to selectively increase L and W to optimize the feed point location, determine the center frequency, and produce the desired bandwidth of the microstrip antenna.

Figure 4:
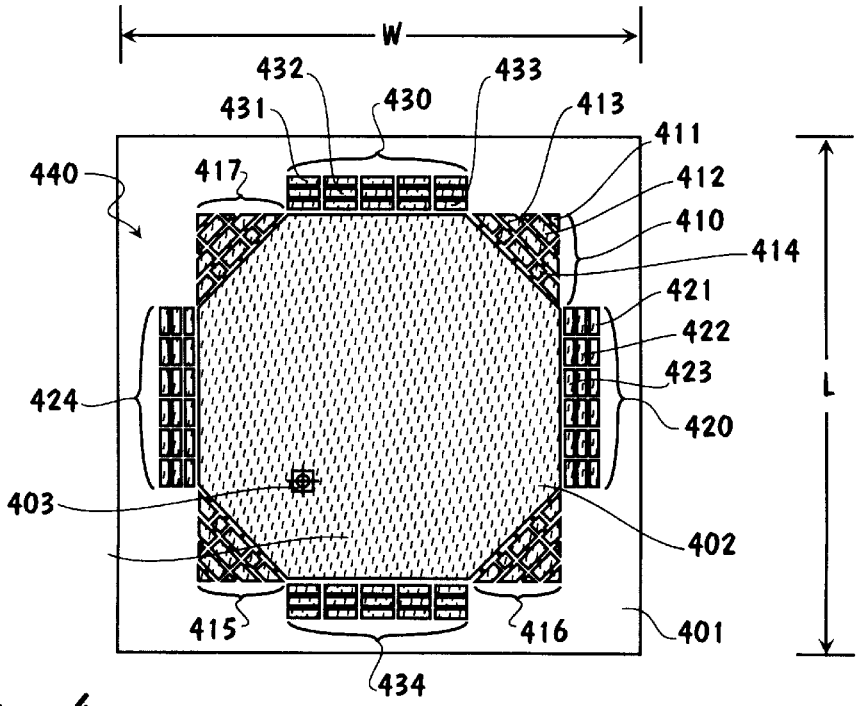
FIG. 4 is a top view of another embodiment of the present invention.

FIG. 4 shows another embodiment of the present invention where individual corner tuning patches are employed in a radiator having chamfered corners. As in FIG. 4, radiator 440 is placed on substrate 401. During the initial manufacturing process, feed point 403 is located on the main patch 402. The set of tuning patches allowing the tunability of radiator 440 includes: four sets of corner tuning patches 410, 415, 416 and 417; two sets of length-affecting tuning patches 430, 434; and two sets of width-affecting tuning patches 420, 424.

In one of the sets of the corner tuning patches 410, a plurality of individual corner patches, such as corner patches 411, 412, 413 and 414, among others, are included. For the set of length-affecting tuning patches 430, three corner tuning patches 431, 432 and 433 are among the many tuning patches within the set. Of the set of width-affecting tuning patches 420, three of the many corner tuning patches include 421, 422 and 423. These individual tuning patches may be initially connected or disconnected, as desired. If they were initially connected, tuning may be accomplished by disconnecting the interconnections among the individual tuning patches and the main patch 402. If these individual tuning patches were initially disconnected, connecting individual tuning patches together with the main patch 402 will tune the radiator 440.

By utilizing chamfered corners, the lengths and widths of the radiator 440 are less defined; the structure is less uniform. Sharp resonance peaks will be less evident and a broader band will result. The dimensions can still be adjusted to optimally locate the feed point, determine the center frequency, and design the bandwidth characteristics as discussed above for the tuning process.

When viewed from above, or a direction orthogonal to the radiating element, the radiating element including the combined connections of the main patch and the selected plurality of tuning patches can be in the shape of a rectangle (including a square), a rectangle (including a square) with chamfered corners, an oval, a triangle, a circle, or any other shape. FIG. 3 shows a square or rectangular shape. FIG. 4 shows a square with chamfered corners. Any shape is possible so long as tuning can be accomplished along multiple dimensions of the radiating element.

In other embodiments, a main patch is not provided. Instead, a plurality of individual tuning patches is provided as the radiating element. By appropriately connecting or disconnecting selected tuning patches, the effective length and the effective width of the connected tuning patches representing the radiating element can be adjusted. The bandwidth of the radiating element is thus produced from the radiating element resulting from the selective connections or disconnections of individual tuning patches.

Bandwidth in terms of percentage is determined by:

$$\% BW = \left(\frac{f_{upper} - f_{lower}}{f_{center}}\right) \times 100$$

where $f_{center}$ is the center frequency. $f_{upper}$ and $f_{lower}$ are the upper and lower frequency, respectively, at which a particular predetermined threshold level (in dB) from a reference level is obtained. Typically, the bounds of the bandwidth are determined by the lowest and highest frequencies at which the magnitude of a signal is located 3 dB below an acceptable reference passband response level. However, other levels have been used.

Return loss provides one means of determining the bandwidth. As a reference signal with a particular magnitude and at various frequencies is delivered to an antenna system, reflected signals are measured. Assuming low-loss dielectric and conductors, so that all loss is due to radiation when the magnitude of the reflected signal at a particular frequency is lower than a predetermined reference level (e.g. more than 5–10 dB below the magnitude of the reference signal), most of the reference signal is delivered to the antenna system for propagation. This frequency is within the bandwidth. If the magnitude of the reflected signal is above the predetermined reference level (e.g. 0–5 dB below the magnitude of the reference signal) an unacceptable amount of the reference signal is reflected back, indicating that the frequency of the reference signal is outside the bandwidth of the antenna.

Figure 5:
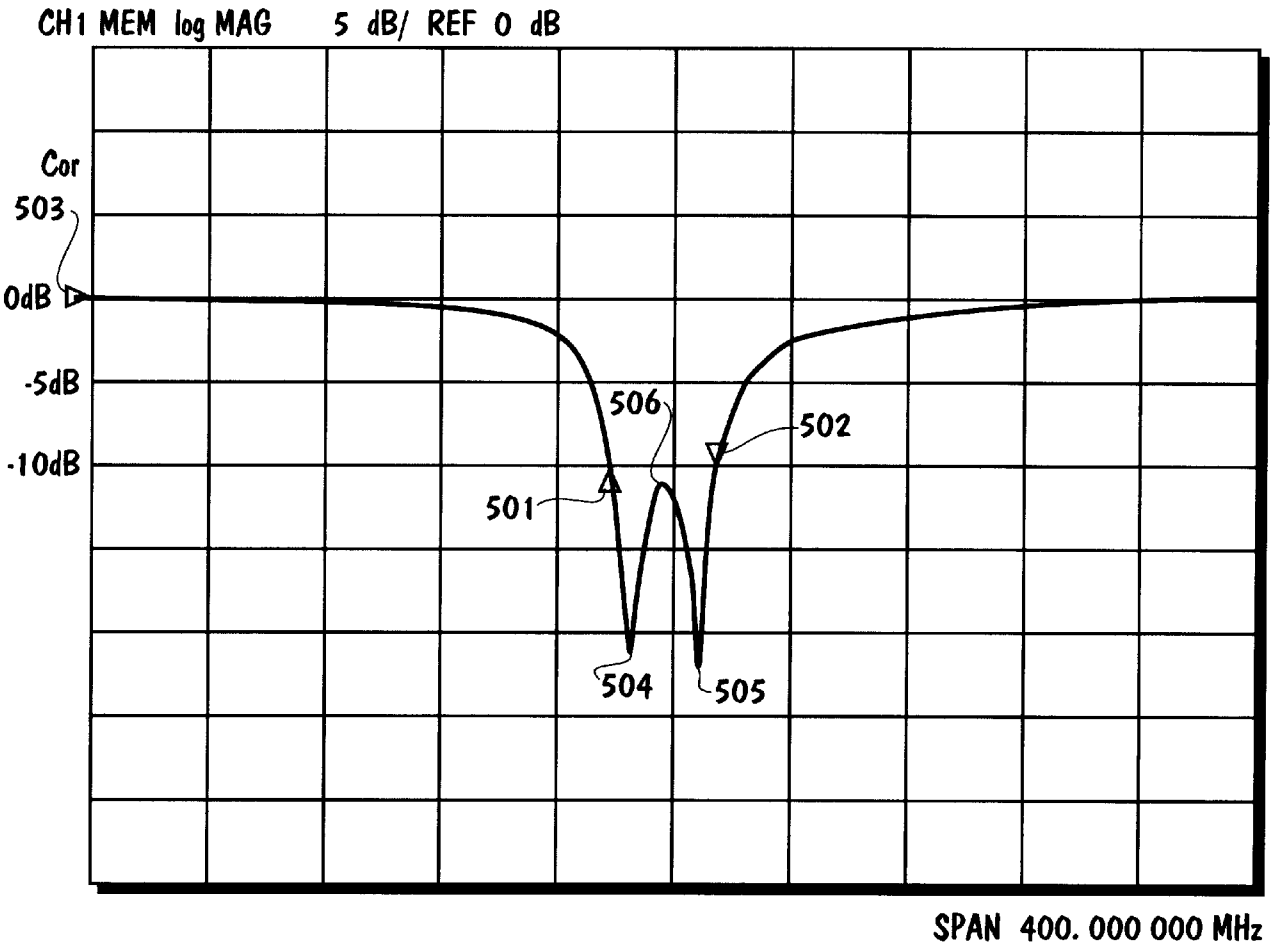
FIG. 5 shows a plot of measured return loss (dB) v. frequency for a prototype embodiment of the present invention showing a 6.25% bandwidth.

FIG. 5 shows the measured results of a prototype double-stub tuned microstrip antenna in accordance with the present invention. This microstrip antenna was built on a very large slab of dielectric material (thickness of 0.5 inch) instead of a 0.120 inch ceramic material. Accordingly, all frequencies are a factor of 4.18 times lower than they would normally be. This was done to facilitate the tuning of the microstrip antenna in the early stages of the design. An optimum feed point was used.

In FIG. 5, the horizontal line designated by marker 503 represents the 0 dB reference for determining the passband. Defining the passband to be any signal below the −10 dB return loss level, the upper frequency $f_{upper}$ designated by marker 502 is 603.44 MHz and the lower frequency $f_{lower}$ designated by marker 501 is 566.879 MHz. The center frequency is 585.16 MHz. The bandwidth is thus approximately 6.25%, a significant improvement over the prior art. The two sharp dips 504 and 505 correspond to the resonant frequencies for the length and width, respectively, of the radiator.

The bandwidth is measured from marker 502 to marker 501 because the return loss magnitude response between these two markers is below the −10 dB reference level. If the dip 506 extended above the −10 dB reference line, the bandwidth is not measured from marker 502 to marker 501. In accordance with the present invention, the tunable microstrip antenna is tuned by connecting or disconnecting selective tuning patches to and from the main patch such that the bandwidths corresponding to the effective length and the effective width of the antenna are adjacent to each other along the frequency spectrum. In addition, dips, such as that represented by dip 506, lying between these adjacent bandwidths should be below the reference passband level. In FIG. 5, the reference passband level is −10 dB return loss.

Usually, the tunable microstrip antenna, in accordance with the present invention, is manufactured with almost identical effective length and effective width. Thus, their respective bandwidths would be identical along the frequency spectrum. As individual tuning patches are selectively connected or disconnected from the main patch during the tuning process, the respective bandwidths, such as those in FIG. 5 represented by dips 504 and 505, can be designed to migrate away from each other. So long as the dip represented by marker 506 does not lie above the reference passband level (−10 dB in FIG. 5), the combined bandwidth of the radiating element is increased such that it is greater than either of the bandwidths corresponding to the effective length and the effective width.

With the appropriate feed point location and adjustment of L and W, the bandwidth is effectively increased without any matching network. FIG. 5 shows the equivalent of over 150 MHz of bandwidth in the 2.4 GHz ISM band.

Figure 6:
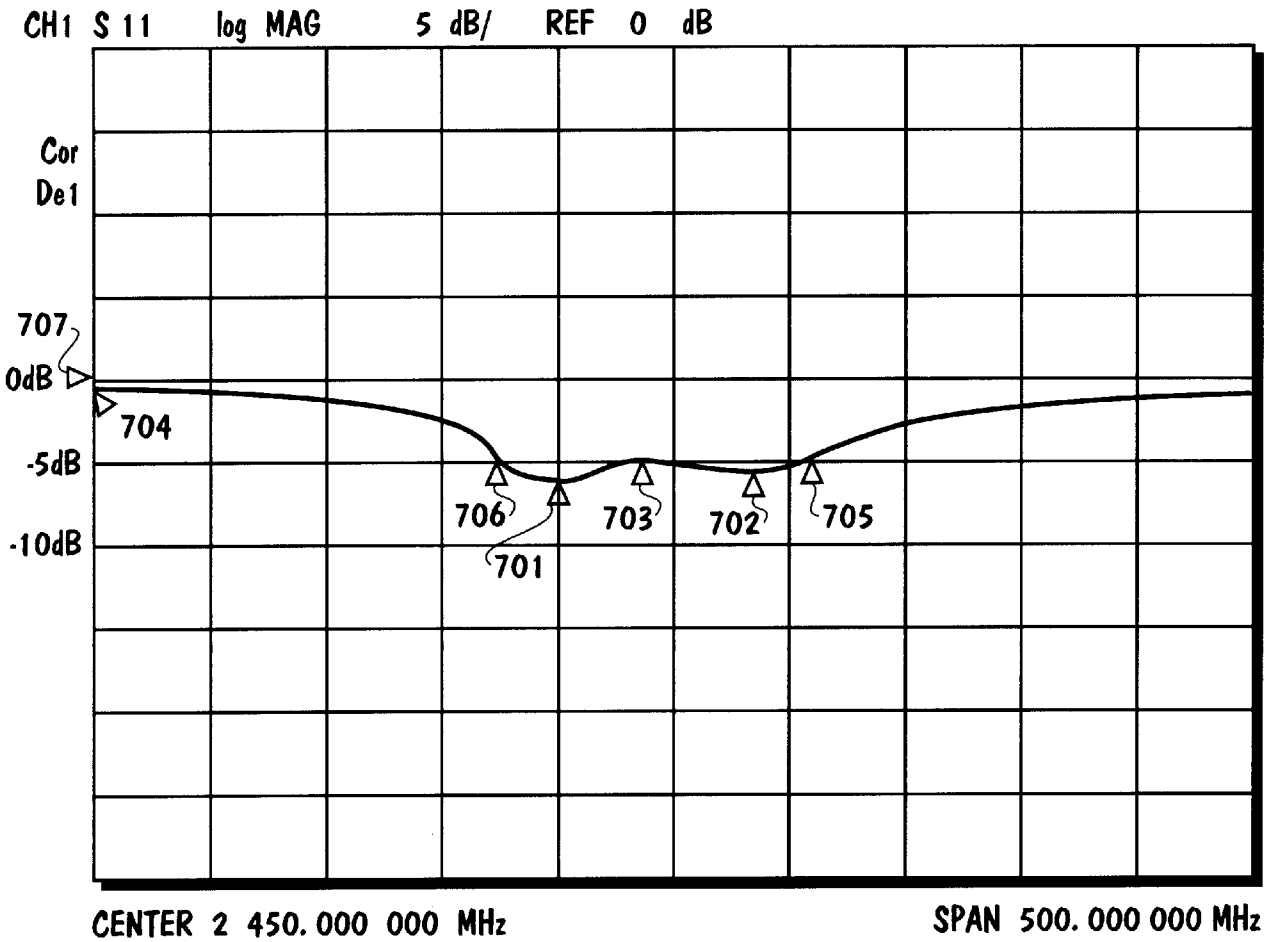
FIG. 6 shows a measured plot of return loss (dB) v. frequency for an embodiment of the present invention showing a 5.3% bandwidth.

FIG. 6 is a plot of a microstrip antenna tuned for maximum bandwidth at a return loss of −5 dB without regard to optimal feed point location. Substantial bandwidth improvement is achieved at a cost of return loss characteristics. The horizontal line designated by marker 707 is the 0 dB reference for determining the passband. For a −5 dB return loss as the passband limit, the upper frequency $f_{upper}$ designated by marker 705 is 2.507 GHz and the lower frequency $f_{lower}$ designated by the marker 706 is 2.378 GHz. The center frequency $f_{center}$ designated by marker 703 is 2.442 GHz. The bandwidth is thus 5.3%. Other points of interest include marker 704 which, at 2.2 GHz, shows a return loss of 0.6522 dB, and the two dips 701 and 702 corresponding to the resonant frequencies for the length and width components of the radiator. Dip 701 shows a 5.9 dB return loss at 2.2 GHz. Dip 702 shows a 5.6964 dB return loss at 2.483 GHz. If the feed point was moved to an optimum location, the plot would resemble that of FIG. 5 at 2.4 GHz. The plot shown in FIG. 6 was taken from a microstrip antenna in accordance with the present invention where corner tuning was utilized. Corner tuning consists of disconnecting or connecting the corner tuning patches from the remaining portion of the radiator. Because corner tuning results in a less uniform microstrip antenna structure, some smearing of the frequency response results; less sharp peaks are evident.

Figure 7:
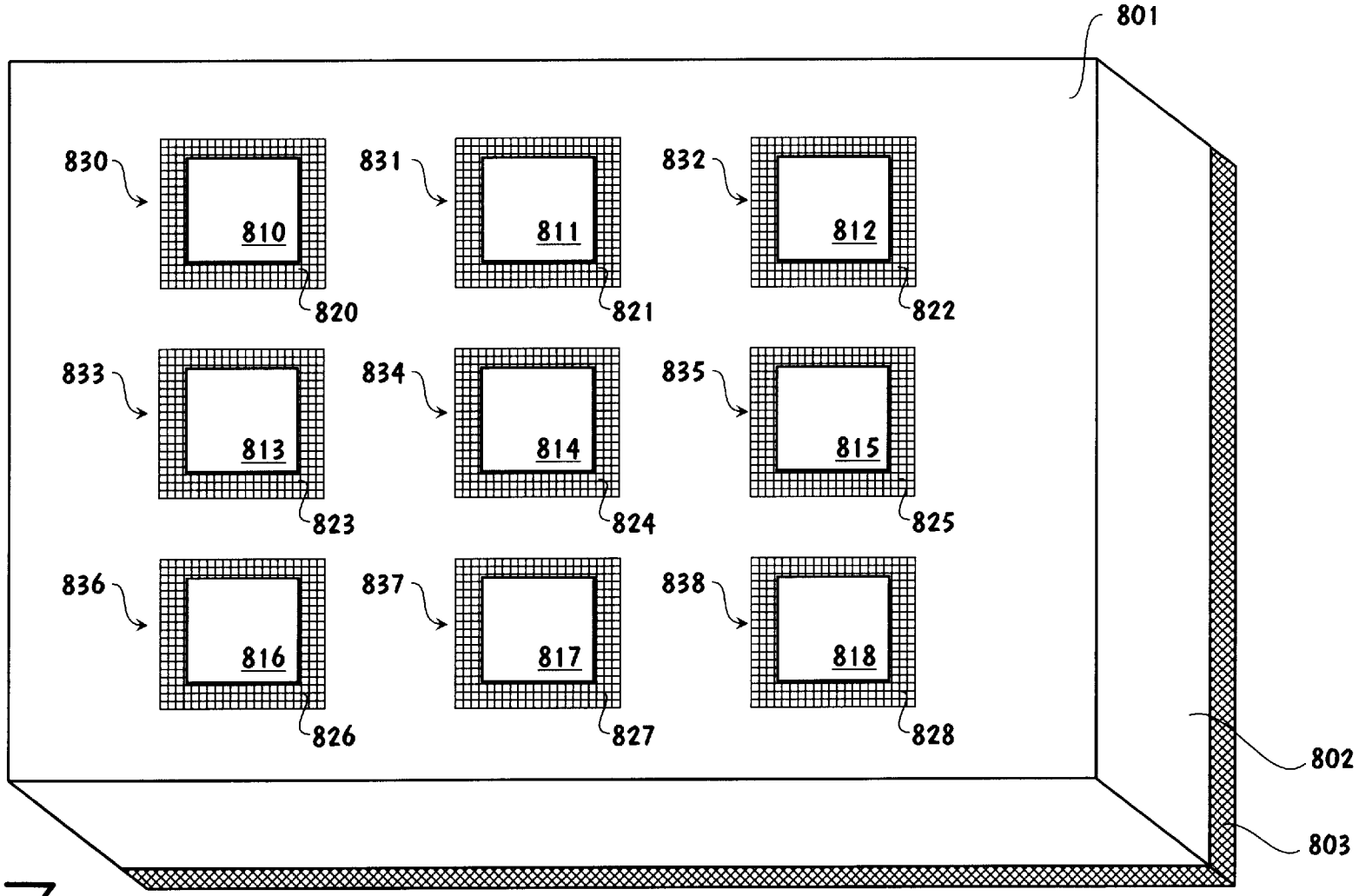
FIG. 7 shows another embodiment of the present invention where the tunable microstrip antenna is configured in an array.

FIG. 7 shows another embodiment of the present invention. The single tunable microstrip antenna described above is now incorporated with other tunable microstrip antennas in an array of tunable microstrip antennas, in accordance with the present invention. If appropriately configured and tuned, the array provides more directivity and broader bandwidths than a single microstrip antenna.

As shown in FIG. 7, the array includes a radiating layer 801, substrate layer 802, and ground plane layer 803. Imbedded or photoetched on the radiating layer 801 is a plurality of radiators 830–838 forming the array. Each radiator includes a main patch 810–818 and a plurality of individual tuning patches 820–828 connected to their respective main patch. The feed point (not shown in FIG. 7) for each radiator is chosen as desired for broad bandwidth and/or optimum matching conditions as discussed above.

As in the case of the single tunable microstrip antenna, each radiator 830–838 in the array can be tuned for broad bandwidth by connecting or disconnecting the individual tuning patches 820–828 and adjusting the dimensions of the radiator 830–838. When the radiators 830–838 are tuned so that their respective bandwidths overlap each other, the array bandwidth can be designed broader than the bandwidth for a single microstrip bandwidth. Each element in the array can also be fed with a signal that is at a different phase angle with reference to the signal at some reference patch.

As an example, radiator 830 can be tuned so that it provides a broad bandwidth of BW1 and center frequency $f_{c1}$. Radiator 831 can be tuned so that it provides a bandwidth of BW2 and center frequency $f_{c2}$. $f_{c2}$ is greater than $f_{c1}$ and the lower frequency end of BW2 overlaps the higher frequency end of BW1. Thus, the combination of radiator 830 and radiator 831 results in a broad bandwidth that is substantially equal to BW1 and BW2. Properly tuning the other radiators 832–838 results in a bandwidth for the array that is substantially equal to the sum of the bandwidths of the individual radiators 830–838.

Although this example shows a geometrically square configuration, other array configurations such as rectangle, circle, or triangle are possible. The shapes of individual radiators in the array may also be varied to produce an appropriate directivity, radiation pattern, and bandwidth.

The array can also increases the directivity of the antenna. The electromagnetic fields of the individual radiators can be configured add in phase in the main beam and cancel in other directions. Electromagnetic fields radiated by the array are obtained by adding the fields radiated by all the individual radiators while taking the interactions between the radiators into account. The radiation pattern and the feed point impedance of a single radiator in the array depend on surrounding radiators and their relative positions in the array. Adjacent radiators must be phased or located in such a way that the radiation will concentrate in only one direction. The use of multiple radiators can also provide a mechanism to electronically scan the antenna.

Figure 8:
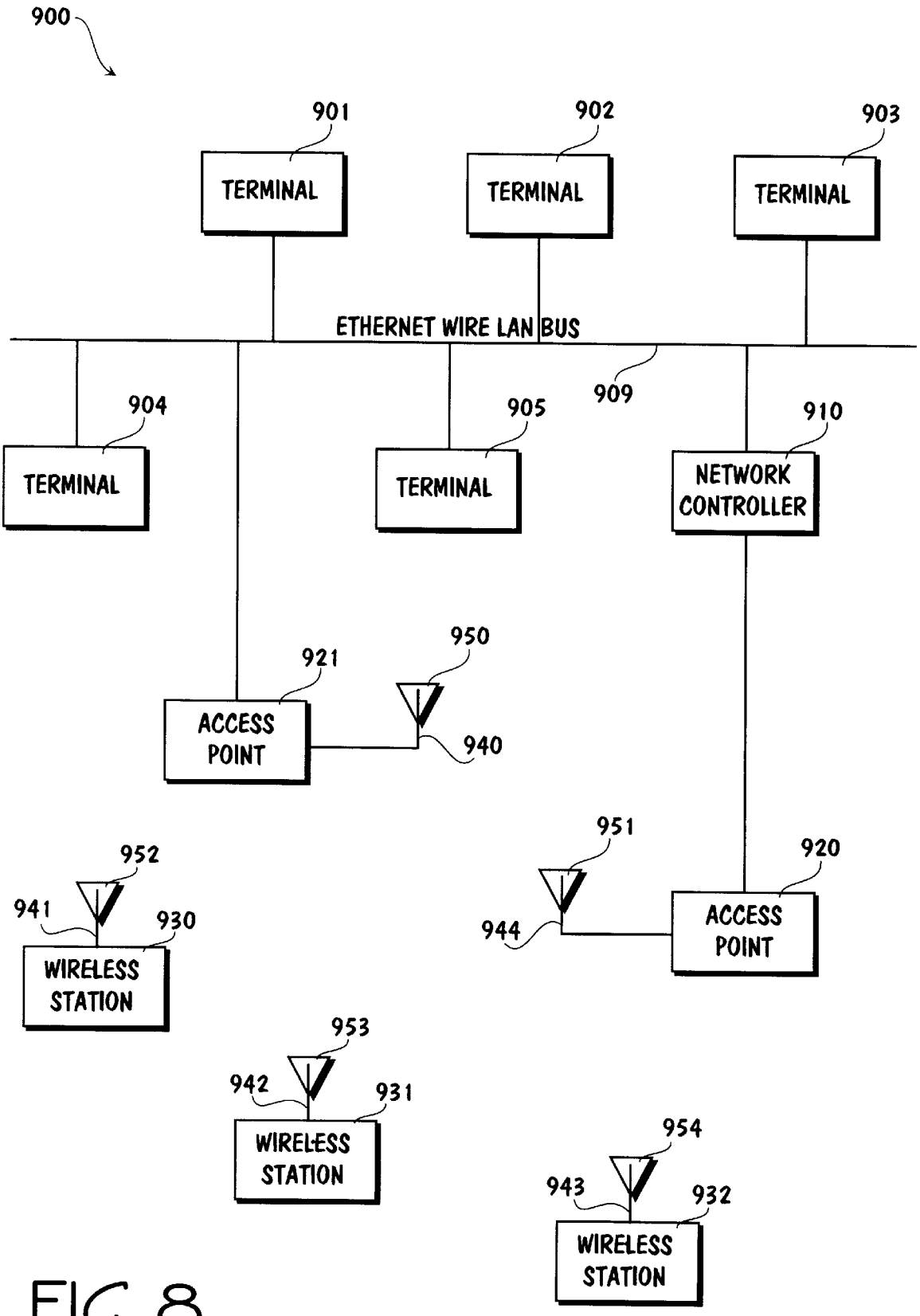
FIG. 8 shows a wireless computer network using the tunable microstrip antenna.

The present invention is particularly adapted for use in a computer network, such as a local area network (LAN) or wide area network (WAN), where wireless stations are used. One example of a LAN is shown in FIG. 8. The network depicted in FIG. 8 is exemplary only; other network configurations such as token rings, token buses, FDDI, and ISDN can be employed.

In FIG. 8, a network 900 comprises an ETHERNET wire-based LAN employing data terminals (or host computers) that are hardwired to the LAN and remote terminals that communicate with the LAN using wireless technology as known in the art. In the ETHERNET wire-based LAN portion of the network 900, a network controller 910 is connected to a bus 909. A plurality of data terminals or host computers 901–905 are hardwired to the network 900 via the bus 909. Access point 921 is also connected to the network via bus 909 for communication with wireless stations. Another access point 920 is connected to the network controller 910 for communication with wireless stations. Each access point has a communication range defined by the transmitter and receiver technology used to define a basic service area as is well known in the art. Wireless stations within a particular communication range of an access point communicate with the network via that access point.

Wireless stations 930–932 are remotely located from bus 909. These wireless stations 930–932 communicate with the wire-based portion of the network 900 through access points 920, 921. This LAN and wireless configuration is well known in the art. Of course, the number of wireless stations, access points, and terminals depends on the needs of a particular application. Indeed, the actual number may be much higher than that shown in FIG. 8.

In addition to the transceiver technology that is well known in the art, electromagnetic signals are radiated through tunable microstrip antennas of the present invention. These tunable microstrip antennas 950–954 are connected to access points 920, 921 and wireless stations 930–932 via feed lines 940–944.

Although a variety of communication channel technologies could be used, the preferred system according to the present invention is implemented using a relatively narrow band frequency modulated NRZ channel in the 2.4 GHz ISM band. The channel bandwidth in the preferred system is between 7 and 14 MHz. However, greater bandwidths may be employed to fully utilize the broadband tunable microstrip antenna of the present invention. This channel allocation system allows for allocating a plurality of channels within the ISM band for adjacent basic service areas.

Instead of the coaxial feed connection for delivering power to the microstrip antenna, other forms of feed techniques can be employed with the present invention. Thus, the present invention can be used with microstrip feed, buried feed, and slot feed.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

I claim:

1. A tunable microstrip antenna for receiving or transmitting a signal, comprising:

a dielectric member having a first side and a second side;

a reference member comprising conductive material on the second side of the dielectric member and coupled to a source of a reference potential;

a radiating member comprising conductive material on the first side of the dielectric member; and a plurality of tuning members comprising conductive material on the first side of the dielectric member and adjacent the radiating member, the plurality of tuning members being one of normally connected electrically to the radiating member and normally disconnected electrically from the radiating member and arranged so that by one of electrically connecting and disconnecting a first tuning member of said plurality of tuning members from the radiating member, the first effective dimension of the radiating member is adjusted.

2. The tunable microstrip antenna of claim 1, wherein the radiating member has a first side generally orthogonal to a first effective dimension, the plurality of tuning members arranged along the first side of the radiating member.

3. The tunable microstrip antenna of claim 1, wherein the radiating member has a first side generally orthogonal to a first effective dimension, and said plurality of tuning members are arranged in a plurality of rows substantially parallel to the first side of the radiating member.

4. The tunable microstrip antenna of claim 1, wherein the radiating member has a first side generally orthogonal to a first effective dimension and a second side opposite the first side, and said plurality of tuning members comprise a first plurality of tuning members arranged along the first side of the radiating member; and a second plurality of tuning members arranged along the second side of the radiating member.

5. The tunable microstrip antenna of claim 1, wherein said plurality of tuning members comprise a second tuning member arranged so that by one of electrically connecting and disconnecting the second tuning member from the radiating member, a second effective dimension of the radiating member is adjusted.

6. The tunable microstrip antenna of claim 5, wherein the radiating member has a first side generally orthogonal to the second effective dimension, and said plurality of tuning members are arranged along the first side of the radiating member.

7. The tunable microstrip antenna of claim 5, wherein the radiating member has a first side generally orthogonal to the second effective dimension, and said plurality of tuning members are arranged in a plurality of rows substantially parallel to the first side of the radiating member.

8. The tunable microstrip antenna of claim 5, wherein the radiating member has a first side generally orthogonal to the second effective dimension and a second side opposite the first side, and said plurality of tuning members comprise a first plurality of tuning members, including the second tuning member, arranged along the first side of the radiating member; and a second plurality of tuning members arranged along the second side of the radiating member.

9. The tunable microstrip antenna of claim 1, wherein the plurality of tuning members and the radiating member are normally connected.

10. The tunable microstrip antenna of claim 1, wherein said plurality of tuning members and the radiating member are normally disconnected.

11. The tunable microstrip antenna of claim 1, wherein the radiating member is substantially rectangular when viewed from above.

12. The tunable microstrip antenna of in claim 1, wherein the radiating member is substantially shaped as one of a circle or an oval when viewed from above.

13. The tunable microstrip antenna of claim 1, including a transmission line coupled to a feed point having an effective position on the radiating member, and wherein the radiating member has an effective impedance determined in part by the effective position of the feed point, and wherein selectively connecting and disconnecting a tuning element in said one or more tuning elements adjusts the effective impedance.

14. A tunable microstrip antenna for receiving or transmitting a signal, comprising:

a dielectric member having a first side and a second side;

a reference member comprising conductive material on the second side of the dielectric member and coupled to a source of a reference potential;

a radiating member comprising conductive material on the first side of the dielectric member, the radiating member being substantially rectangular with chamfered comers when viewed from above; and a plurality of tuning members comprising conductive material on the first side of the dielectric member and adjacent the radiating member, the plurality of tuning members being one of normally connected electrically to the radiating member and normally disconnected electrically from the radiating member and arranged so that by one of electrically connecting and disconnecting a first tuning member of said plurality of tuning members from the radiating member, the first effective dimension of the radiating member is adjusted.

15. A tunable microstrip antenna for receiving or transmitting a signal, comprising:

a dielectric member having a first side and a second side;

a reference member comprising conductive material on the second side of the dielectric member and coupled to a source of a reference potential;

a radiating member comprising conductive material on the first side of the dielectric member, the radiating member having a first effective dimension corresponding to a first radiating bandwidth and a second effective dimension corresponding to a second radiating bandwidth different than but overlapping with the first radiating bandwidth; and a set of tuning members comprising conductive material on the first side of the dielectric member and adjacent the radiating member, the tuning members in said set being one of normally connected electrically to the radiating member and normally disconnected electrically from the radiating member and arranged so that by one of electrically connecting and disconnecting tuning members of said set of tuning members from the radiating member, the radiating member is tuned, and wherein the radiating member has a first side generally orthogonal to the first effective dimension, and a second side generally orthogonal to the second effective dimension, and said set of tuning members comprise a first plurality of tuning members arranged along the first side of the radiating member; and a second plurality of tuning members arranged along the second side of the radiating member.

16. The tunable microstrip antenna of claim 15, wherein the radiating member has a third side generally orthogonal to the first effective dimension and opposite the first side, and a fourth side generally orthogonal to the second effective dimension and opposite the second side, and said set of tuning members comprise a third plurality of tuning members arranged along the third side of the radiating member; and a fourth plurality of tuning members arranged along the fourth side of the radiating member.

17. The tunable microstrip antenna of claim 16, including a transmission line coupled to a feed point having an effective position on the radiating member, and wherein the radiating member has an effective impedance determined in part by the effective position of the feed point, and wherein selectively connecting and disconnecting tuning elements in the set of tuning elements adjusts the effective impedance.

18. The tunable microstrip antenna of claim 15, including a transmission line coupled to a feed point having an effective position on the radiating member, and wherein the radiating member has an effective impedance determined in part by the effective position of the feed point, and wherein selectively connecting and disconnecting tuning elements in the set of tuning elements adjusts the effective impedance.

19. The tunable microstrip antenna of claim 15, wherein the radiating member is substantially rectangular when viewed from above.

20. The tunable microstrip antenna of claim 15, wherein the radiating member is shaped substantially as one of a circle and an oval when viewed from above.

21. A tunable microstrip antenna for receiving or transmitting a signal, comprising:

a dielectric member having a first side and a second side;

a reference member comprising conductive material on the second side of the dielectric member and coupled to a source of a reference potential;

a radiating member comprising conductive material on the first side of the dielectric member, the radiating member being substantially rectangular with chamfered corners when viewed from above; and a plurality of tuning members comprising conductive material on the first side of the dielectric member and adjacent the radiating member, the plurality of tuning members being one of normally connected electrically to the radiating member and normally disconnected electrically from the radiating member and arranged so that by one of electrically connecting and disconnecting the plurality of tuning members from the radiating member, the radiating member is tuned, and wherein the radiating member has a first side generally orthogonal to a first effective dimension, and said plurality of tuning members comprise a first plurality of tuning members arranged along the first side of the radiating member; and a second plurality of tuning members arranged along the second side of the radiating member.

22. An array of tunable microstrip antennas with an array bandwidth, comprising:

a substrate layer;

a plurality of tuning members coupled to the substrate layer, the plurality of tuning members having a plurality of corresponding element bandwidths, where each tuning member has a first dimension and a second dimension where at least one of the first dimension and the second dimension is adjustable to tune the element bandwidth, and wherein at least two of the plurality of tuning members are tuned such that their respective corresponding element bandwidths are adjacent to each other along a frequency spectrum to form the array bandwidth; and a reference layer coupled to the substrate layer.

23. An array of tunable microstrip antennas as in claim 22, wherein the tunable radiating element comprises a plurality of tuning patches, wherein at least one of the first dimension and the second dimension is adjusted by connecting or disconnecting selected ones of the plurality of tuning patches to each other.

24. An array of tunable microstrip antennas as in claim 23, wherein the tunable radiating element comprises:

a main patch adjacent the plurality of tuning patches, wherein at least one of the first dimension and the second dimension is adjusted by connecting or disconnecting selected ones of the plurality of tuning patches to the main patch.

25. An array of tunable microstrip antennas as in claim 24, wherein the plurality of tuning patches surrounds at least a portion of a perimeter of the main patch.

26. An array of tunable microstrip antennas as in claim 22, wherein the first dimension is effective length for establishing a first resonant frequency corresponding to a first bandwidth and the second dimension is effective width for establishing a second resonant frequency corresponding to a second bandwidth, wherein the effective length and the effective width are different such that the first bandwidth and the second bandwidth overlap to form an element bandwidth that is greater than either the first bandwidth or the second bandwidth.

27. An array of tunable microstrip antennas as in claim 22, further comprising:

a feed point coupled to the tuning members at a particular location in the tuning members for transmitting or receiving an electromagnetic signal, the feed point having a radiation impedance which varies with the location of the feed point in the tuning member.

* * * * *